US006231121B1

(12) United States Patent
Chrisco et al.

(10) Patent No.: US 6,231,121 B1
(45) Date of Patent: May 15, 2001

(54) COMBINATION BENCH AND TABLE

(75) Inventors: Larry L. Chrisco, Fairland; Orval Lee Fick, Miami, both of OK (US)

(73) Assignee: Blitz U.S.A., Inc., Miami, OK (US)

( * ) Notice: Subject to any disclaimer, the term of this patent is extended or adjusted under 35 U.S.C. 154(b) by 0 days.

(21) Appl. No.: 09/566,502

(22) Filed: May 8, 2000

(51) Int. Cl.[7] ..... A47B 85/04
(52) U.S. Cl. ..... 297/124
(58) Field of Search ..... 297/124, 125, 297/126, 232, 118

(56) References Cited

U.S. PATENT DOCUMENTS

| | | | | |
|---|---|---|---|---|
| 1,757,960 | * | 5/1930 | Greenstreet | 297/124 |
| 2,758,633 | * | 8/1956 | Apple | 297/124 |
| 2,882,957 | * | 4/1959 | Anderson | 297/124 |
| 3,361,470 | * | 1/1968 | Gustin et al. | 297/124 |
| 4,194,784 | * | 3/1980 | Dostal et al. | 297/126 |

FOREIGN PATENT DOCUMENTS

| | | | | |
|---|---|---|---|---|
| 906247 | * | 9/1962 | (GB) | 297/126 |

* cited by examiner

*Primary Examiner*—Peter R. Brown
(74) *Attorney, Agent, or Firm*—Hovey, Williams, Timmons & Collins

(57) ABSTRACT

A combination bench and table unit includes a pair of frames with a bench fixed thereto, the frames having legs supporting the unit and upwardly extending supports which carry a table/backrest member. The table/backrest member is attached to the supports by a retaining assembly which includes a hinge to thereby permit swinging of the table/backrest member from a first vertical position where it serves as a backrest to a second horizontal position where it serves as a table. The bench and the table/backrest members are identical in configuration and construction and the two frame members are identical whereby to minimize the need for molds to fabricate the unit.

12 Claims, 3 Drawing Sheets

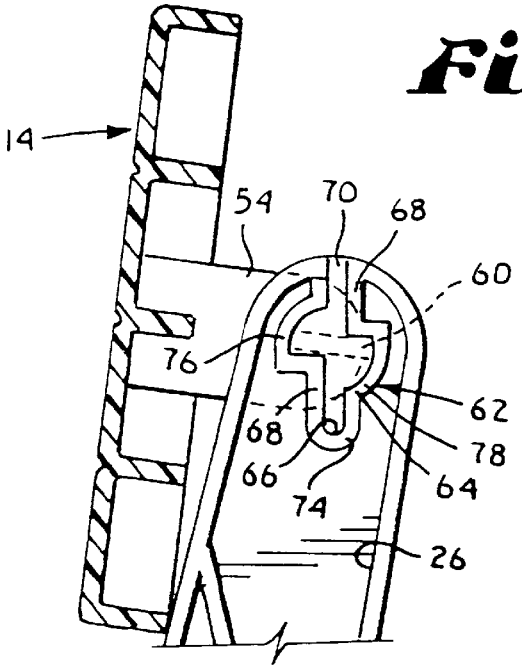
Fig.3.
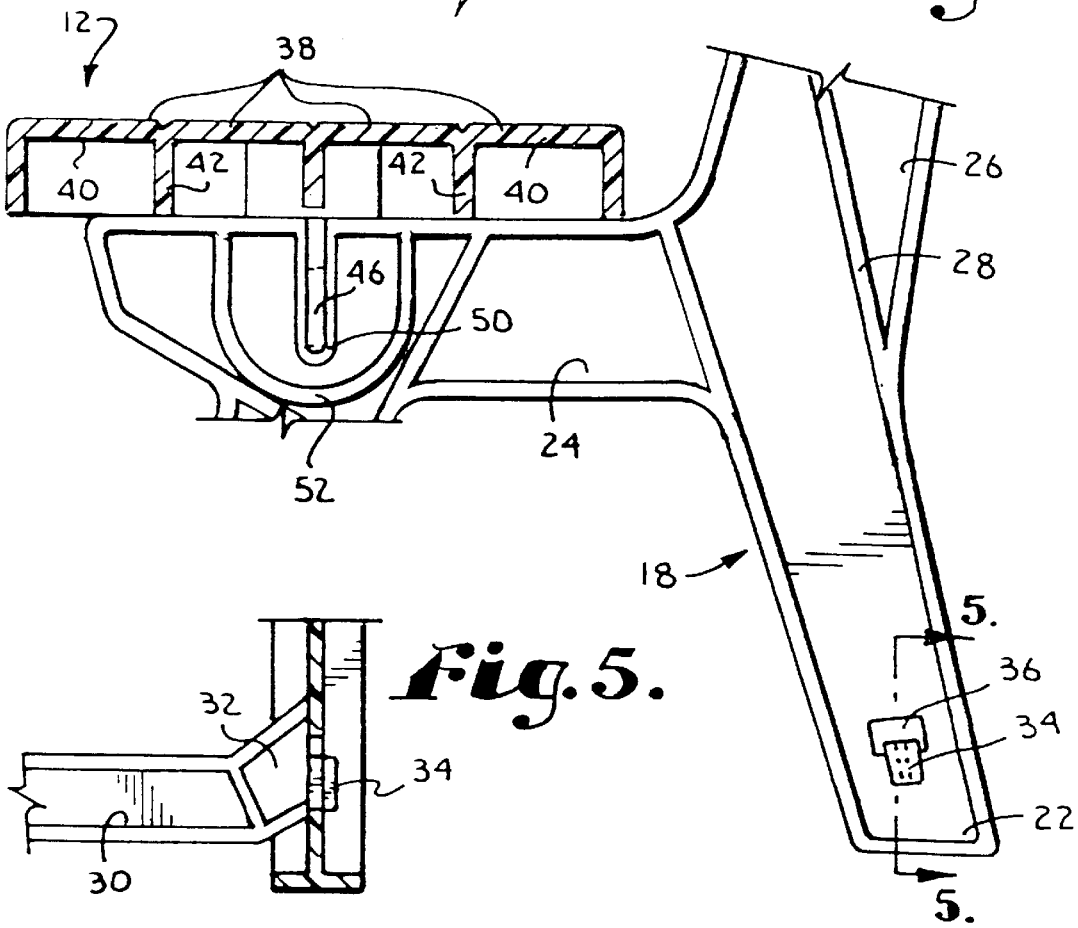
Fig.4.
Fig.5.

COMBINATION BENCH AND TABLE

BACKGROUND OF THE INVENTION

1. Field of the Invention

The present invention relates to a combination bench and table wherein the bench is fixed but the table may be swung from an upward, horizontal position to a lowered, vertical position to serve as a backrest for the bench.

2. Description of Prior Art

The concept of providing, in a single unit, a piece of furniture which may function as a bench to sit upon and then be converted to an arrangement where the back of the bench becomes a table has been known for some time and patents covering various forms of this concept would include the following: Dostal et al. U.S. Pat. No. 4,194,784; Donnell, Jr. U.S. Pat. No. 4,913,488; Watts et al. U.S. Pat. No. 5,292,172; Watts et al. U.S. Pat. No. 5,398,990; and Cooper et al. U.S. Pat. No. 5,704,683.

With the advent of advanced plastic molding techniques and the increasing cost of molds for fabricating large plastic items, it has become desirable to minimize the expense of the molds and the plastic utilized in fabricating a furniture item such as the combination bench and table disclosed herein. The prior art referred to above does not take into consideration these factors and thus the present invention distinguishes over the prior art wherein the bench and table/backrest components are not identical nor are the frame members always identical, as contemplated by the present invention.

Yet further, the components of the present combination bench and table are interconnected in such a way that the bench may be readily fixed to the frame members which support it and which rest upon a supporting surface and the backrest/table member may be swingably supported by the frame so that it may be quickly and readily shifted from its vertical position to its position as a table.

These economics in molding of the present unit distinguish it from the prior art teachings referred to above as does the specific structure for fixing the bench to the frame and the structure for holding the backrest/table member in its two positions of use.

SUMMARY OF THE INVENTION

The combination bench and table unit disclosed herein constitutes a bench member which is fixed in its position upon a pair of spaced apart supporting frames, the frames having legs which extend downwardly to engagement with a supporting surface.

The backrest/table member is identical in configuration and construction to the bench member whereby both members may be fabricated from a single mold, as the item is to be fabricated from a suitable plastic material.

The frame members each have a horizontal bench rest which connects the pair of legs of each frame and has molded therein a slot for receiving tabs depending from the bench, which tabs may be readily inserted and press fitted into the slots to firmly fix the bench in its position upon the frame, since no movement of the bench is desired.

The frame members are two in number and are spaced apart to support opposite ends of the bench and the table. The frames each have upwardly extending supports which carry the table/backrest member which is identical in construction to the bench.

However, the table/backrest member is coupled with the supports by means of corresponding hinges which receive tabs carried by the table member, the tabs being selectively positioned within the hinge whereby to either retain the table/backrest member in its horizontal position to function as a table or, upon slight movement of the table backrest member, to permit swinging movement thereof with respect to the frame to assume a vertical position whereby to serve as a backrest for the bench.

The hinge structure is fabricated as part of the upwardly extending supports and is in the form of an outwardly extending wall having opposed, vertically offset segments, each having an arcuate stretch to permit the swinging of the table/backrest portion. The wall also defines a notch which receives the pins carried by the backrest/table member, the notch having a closed lower end terminating below the segments and a second, open end terminating above the segments. The pins rest in the notch when the table is in its horizontal position and are shiftable away from the one end of the notch into the segment area whereby to permit swinging of the pins and therefore the table to a vertical position to function as a backrest.

Thus, in its table condition, the table/backrest member is in a horizontal plane spaced from and coplanar with the bench and, when in its backrest position, is in a vertical position with the lower edge of the table/backrest member engaging the frame.

BRIEF DESCRIPTION OF THE DRAWINGS

FIG. 3 is a partially sectional, fragmentary view showing the table/backrest member in its vertical position to function as a backrest and including the support member and hinge which carries the table/backrest member;

FIG. 4 is a partially sectional, fragmentary view showing the bench as supported by the frame with portions of the frame being broken away;

FIG. 5 is a sectional view taken on line 5—5 of FIG. 4;

DESCRIPTION OF THE PREFERRED EMBODIMENTS

Figure 1:
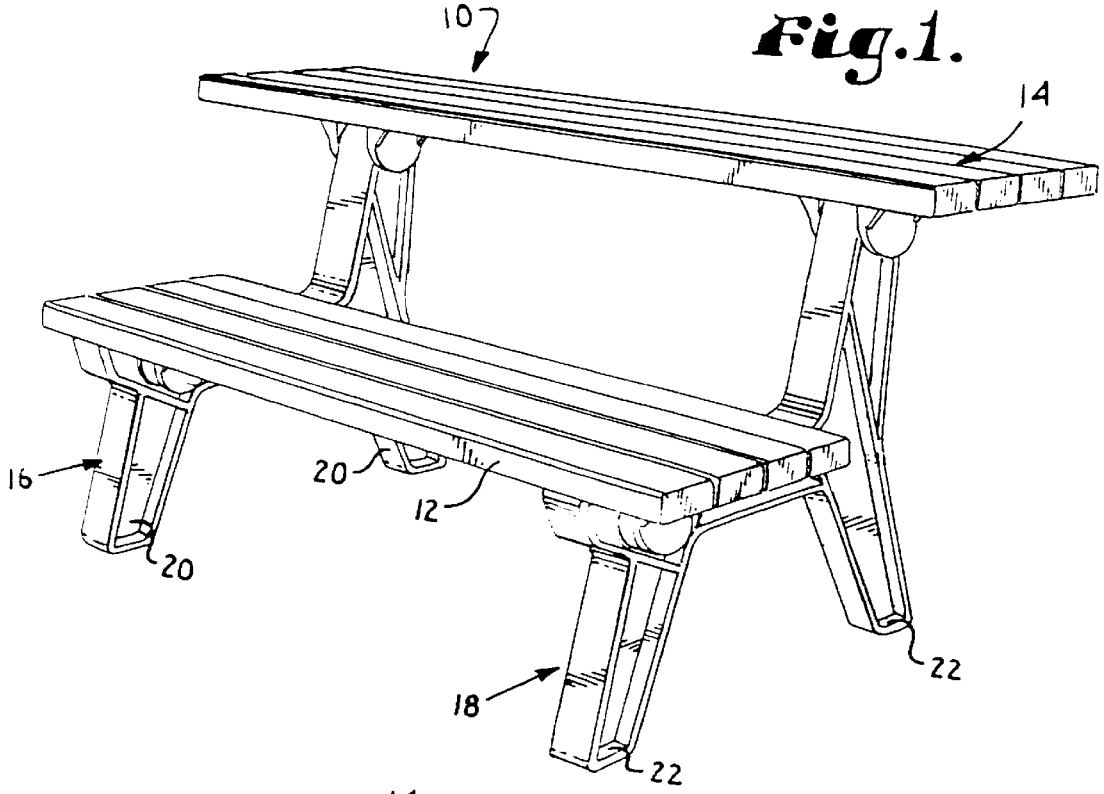
FIG. 1 is a perspective view showing the combination bench and table arranged to function in its table condition.
Figure 2:
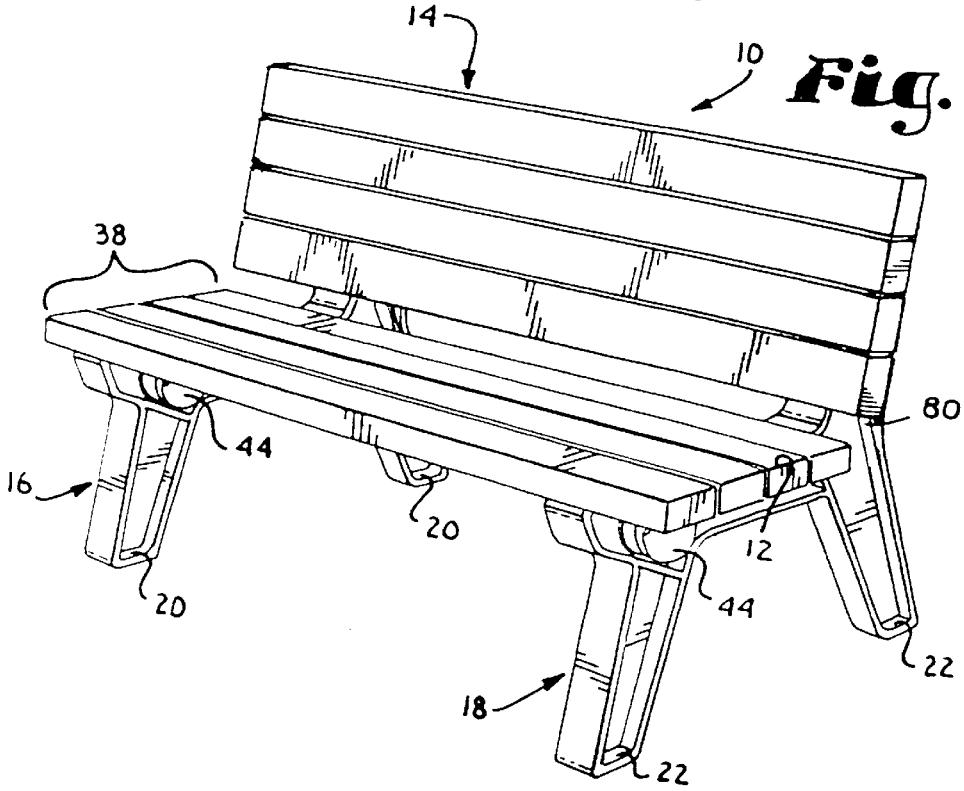
FIG. 2 is a comparable perspective view but showing the combination bench and table arranged to function in its bench condition.

The combination bench and table is illustrated in FIGS. 1 and 2 and is identified as 10 in the illustration in FIG. 1 wherein the unit is arranged in its position to function as a table. The unit is also identified as 10 in FIG. 2 which illustrates the unit with its components arranged to function as a bench.

Broadly, combination bench and table 10 includes a fixed bench member 12; a shiftable table/backrest member 14; and a pair of spaced apart frames 16 and 18.

The entire unit is preferably molded from a suitable plastic material and the bench 12 and table/backrest member are each of identical construction whereby to economize in the requirement for molds inasmuch as both of these components may be fabricated from a single mold. Likewise, the frames 16 and 18 are identical and may also be fabricated from a single mold.

Each of the frames 16 and 18 includes a pair of legs 20 and 22, respectively, which extend downwardly to a supporting surface such as the ground, a deck, a patio, or the like, since the unit would probably be used primarily out of doors, as a picnic table, for instance.

Figure 6:
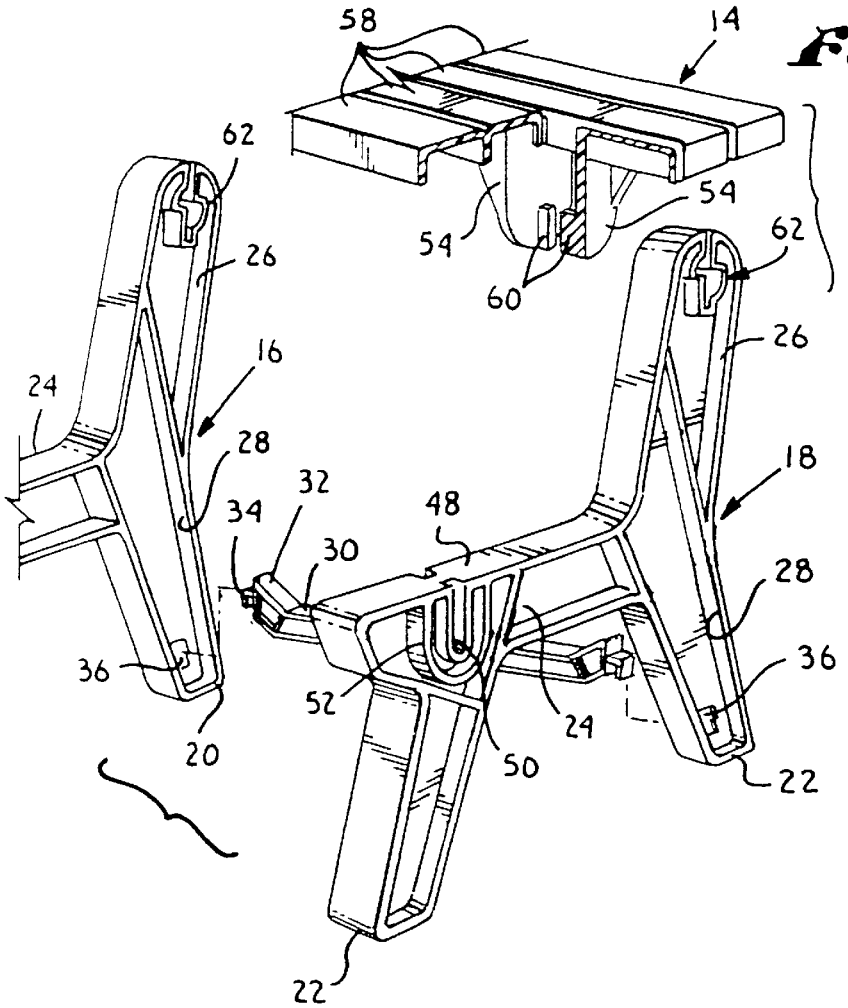
FIG. 6 is an exploded, fragmentary, partially sectional view showing the table/backrest member; portions of the two frame members and the brace used to interconnect the frame members.

As shown in FIGS. 4 and 6, each of the frames 16 and 18 presents a normally horizontal bench rest 24 and an upwardly extending support 26. Suitable ribs such as 28 are provided as needed to add strength and rigidity to the structure.

A brace 30 extends between the normally rearmost legs, in the form depicted, whereby to connect rear leg 20 of frame 16 with corresponding rear leg 22 of frame 18 and give further strength and rigidity to the unit when it is assembled. As seen in FIG. 5, the brace 30 has an angled end 32 which carries a fitting 34, which fitting 34 is received in corresponding apertures 36 which are formed in rear legs 20 and 22 of frames 16 and 18 respectively, all as illustrated in FIG. 6.

The bench member 12 is, in the form illustrated, comprised of four simulated slats 38 which are arranged in side by side relationship to collectively form the bench 12 upon which a user of the unit would sit when the unit functions in that capacity. As shown in FIG. 4, for instance, the slats 38, which are molded from plastic, each have a top stretch 40 with depending sidewalls such as 42, the bench 12 and its slats 38 being molded as a single monolithic unit, as illustrated.

The bench 12 has, at each end thereof, a pair of downwardly extending bosses 44, each of the opposed bosses 44 having an inwardly extending tab 46, the innermost ends of the tabs 46 being spaced apart whereby to straddle an area 48 of the bench rest 24 as illustrated in the FIG. 6, for instance.

When the unit is assembled, the tabs 46 are pushed downwardly within tracks 50 which are defined on each side of each of the frames 20 and 22 in the bench rest portions 24 thereof as best illustrated in FIGS. 4 and 6. The tabs 46 are pushed downwardly into the tracks 50 until they bottom out in the track and concurrently the walls 42 of the slats 38 engage the upper face of the bench rest 24 as illustrated in FIG. 4. The engagement of the tabs 46 within tracks 50 serves to fix the bench with respect to the two frames, since tabs and tracks are provided on each of the spaced apart frames whereby the bench is similarly supported at each end thereof and cannot be shifted once it has been fully pushed downwardly.

If desired, screw blocks could be positioned on the top face of bench rest 24 whereby the bench would be screwed to the supporting frame, if desired, to ensure absolute rigidity in the total unit, such screw blocks not being illustrated.

When the bench is affixed to the two spaced apart supporting frames in the manner described above, the bosses 44 cover the interfitting areas of engagement whereby to present an aesthetically pleasing appearance and also prevent entry of foreign matter into the track 50 and its surrounding wall 52, which wall is complemental to the configuration of the bosses 44.

The table/backrest member 14 is identical in construction to the bench member 12 and thus also includes bosses 54 which depend from the lower face of the table/backrest and the simulated slats 58 which constitute the table/backrest 14.

The bosses 54 each have inwardly extending pins 60 which are received within retaining structure 62. The retaining structure 62 includes walls, such as best shown in FIG. 3 and FIG. 7, which define a hinge 64 which permits swinging movement of the table/backrest 14 by virtue of movement of the pins 60 within their corresponding hinges.

Figure 7:
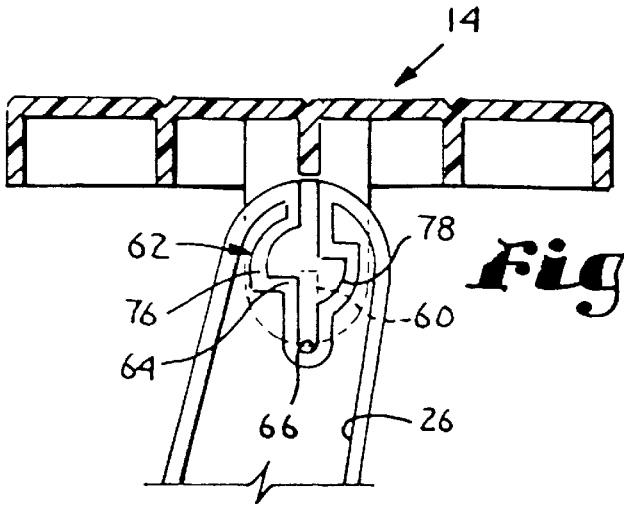
FIG. 7 is a partially sectional, fragmentary view showing the table/backrest member in its horizontal position and illustrating a part of the support which carries said member and the hinge unit which connects the table/backrest member with the support.

As shown in FIG. 7, when the table/backrest member 14 is in its horizontal position, the pin 60 is in a vertical position and is seated at the closed end of a slot 66 whereby to retain the table/backrest member 14 in its horizontal position. The slot 66 is defined by opposed walls 68. The slot 66 also has a normally uppermost open end portion 70 through which the pin 60 is initially inserted into the retaining member 62.

When initially inserted and table/backrest 14 is pushed downwardly, the pins 60 carried by the bosses 54 at each end thereof will each seat in the closed end of the slot 66 and thus retain the table/backrest member 14 in the condition illustrated in FIG. 1 wherein member 14 serves as a table. It will be appreciated that a person or persons may sit on the bench 12 and face the table member 14 and thus utilize the table 14 for any desired purpose.

When it is desired to convert the unit 10 to a bench, as illustrated in FIG. 2, the table/backrest member 14 is lifted upwardly so that the pins 60 all clear corners 74 presented by the walls which define hinge 64 just above the bottom of slot 66, as illustrated in FIG. 3. Once this corner has been cleared, the pin may be swung between the arcuate walls 76 and 78 to assume a horizontal position within the hinge, as illustrated, with the table/backrest member to which the pin is connected by bosses 54 then assuming a vertical position with the leading edge 80 of the table/backrest member 14 engaging the front of the supports 26. Thus the table/backrest member 14 is held in its vertical position by virtue of the position of the pin 60 within the hinge of retaining member 62, as illustrated in FIG. 3, and also by virtue of its engagement with the front of the support members 26.

As is apparent, the unit 10 may be readily disassembled for storage merely by lifting up on the bench 12 to remove tabs 46 from their corresponding tracks 50 and by swinging the table/backrest member 14 to its horizontal position and then lifting upward when the pin is in the position shown in FIG. 7 to thereby remove the table/backrest from the supports 26. Brace 30 may then be lifted out of the apertures 36 by pulling upwardly thereon and the frames 16 and 18 are then free to be stored or packed. This permits the entire unit to be accommodated within a very small space for shipping purposes, but readily assembled by the user at its destination. This assembly is accomplished by placing the frames 16 and 18 in a vertical position, inserting the tabs 46 into the tracks 50 of each of the frame members and then placing table/backrest 14 in a horizontal position and pushing pins 60 downwardly into their corresponding slots 66 defined by the retaining members 62 at the upper end of each of the supports 26.

To facilitate the assembly and disassembly of the unit, elongated openings may be formed in both the bench 12 and the table/backrest 14 which would be above the connecting areas so that the user may look through the openings and ensure that, in the case of the table/backrest, the pins 60 are positioned to be moved into the slots 66. Such an opening also facilitates the swinging of the member 14 since one could view the hinge area and ensure that the pins 60 are moved upwardly sufficiently to permit swinging of the member 14. Likewise an opening in the bench permits the user to align the tabs 46 with the tracks 50 when assembling the unit 10.

What is claimed is:

1. A combination table and bench comprising:

a fixed bench member;

a shiftable table/backrest member;

a pair of frames for supporting said members, said frames being essentially identical;

a pair of generally vertically disposed legs on each of said frames for engagement with a supporting surface;

a horizontal bench rest connecting the pair of legs of each frame;

a support extending upwardly from each of said bench rests;

an identical locking assembly on each of the bench rests for receiving the bench to fix it in place, said locking assembly presenting a track, said bench member having projections received within corresponding tracks to fix the bench member with respect to the frame;

retaining structure on each of the supports to hold the table/backrest in a first, vertical position as a backrest for the bench and to permit swinging of the table/backrest member from said first vertical position to a second horizontal position as a table, said table/backrest member and said bench member being essentially identical in overall construction and configuration.

2. A combination table and bench as set forth in claim 1, said retaining structure including walls defining a hinge, said table/backrest having pins received within said hinge for movement relative thereto to permit said swinging of the table/backrest from said first vertical position to said second horizontal position.

3. A combination table and bench rest as set forth in claim 2, said walls defining a pair of vertically offset segments, each having a stretch of wall which is arcuate to thereby permit shifting movement of the pin when it is between said segments and therefore swinging movement of the table/backrest member.

4. A combination table and bench as set forth in claim 3, said walls also defining a slot having a first closed end terminating below said segments and a second, open end terminating above said segments and for receiving the pin.

5. A combination table and bench as set forth in claim 4, the pin being at the closed end of the slot when the table/backrest is in said second, horizontal position.

6. A combination table and bench as set forth in claim 5, there being a boss connecting the pin to the table/backrest.

7. A combination table and bench as set forth in claim 6, the pin being shiftable away from said first closed end of the slot to move it to within the segments to thereby permit swinging of the pin, the boss and the table/backrest to a vertical position.

8. A combination table and bench as set forth in claim 7, the wall defining the segments and the slot having components for engaging the pin and holding it and thus the bracket in said second horizontal position.

9. A combination table and bench as set forth in claim 8, the leading edge of the table/backrest member engaging the supports when the table/backrest member is in said first vertical position.

10. A combination table and bench as set forth in claim 9, the table/backrest member being in a horizontal plane coplanar with that of the bench when the table/backrest member is in the second, horizontal position.

11. A combination table and bench as set forth in claim 1, a brace spanning the distance between an opposed pair of the legs to add rigidity to the combination bench and table/backrest assembly.

12. A combination table and bench as set forth in claim 11, there being apertures in each of said opposed pair of legs for receiving opposite ends of the brace.

* * * * *